US006204819B1

(12) United States Patent
Hayes et al.

(10) Patent No.: US 6,204,819 B1
(45) Date of Patent: Mar. 20, 2001

(54) CONVERTIBLE LOOP/INVERTED-F ANTENNAS AND WIRELESS COMMUNICATORS INCORPORATING THE SAME

(75) Inventors: Gerard James Hayes, Wake Forest; Robert A. Sadler, Raleigh, both of NC (US)

(73) Assignee: Telefonaktiebolaget L.M. Ericsson (SE)

( * ) Notice: Subject to any disclaimer, the term of this patent is extended or adjusted under 35 U.S.C. 154(b) by 0 days.

(21) Appl. No.: 09/576,086

(22) Filed: May 22, 2000

(51) Int. Cl.[7] ..... H01Q 9/04; H01Q 1/38

(52) U.S. Cl. ..... 343/702; 343/700 MS; 455/90

(58) Field of Search ..... 343/700 MS, 741, 343/866, 702, 860; 455/90

(56) References Cited

U.S. PATENT DOCUMENTS 6,025,805 * 2/2000 Smith et al. ..... 343/702

FOREIGN PATENT DOCUMENTS 2316540 2/1998 (GB) .

10-224142 8/1998 (JP) .

* cited by examiner

*Primary Examiner*—Thu Phan
*Assistant Examiner*—James Clinger
(74) *Attorney, Agent, or Firm*—Myers Bigel Sibley & Sajovec

(57) ABSTRACT

Multiple frequency band antennas having first and second conductive branches are provided for use within wireless communications devices, such as radiotelephones. A first conductive branch has first and second feeds extending therefrom that terminate at respective first and second micro-electromechanical systems (MEMS) switches. A second conductive branch is in adjacent, spaced-apart relationship with the first conductive branch. One end of the second conductive branch terminates at a third MEMS switch and the opposite end of the second conductive branch is connected to the first conductive branch via a fourth MEMS switch. The fourth MEMS switch is configured to be selectively closed to electrically connect the first and second conductive branches such that the antenna radiates as a loop antenna in a first frequency band. The fourth switch is also configured to open to electrically isolate the first and second conductive branches such that the antenna radiates as an inverted-F antenna in a second frequency band different from the first frequency band.

77 Claims, 7 Drawing Sheets

CONVERTIBLE LOOP/INVERTED-F ANTENNAS AND WIRELESS COMMUNICATORS INCORPORATING THE SAME

FIELD OF THE INVENTION

The present invention relates generally to antennas, and more particularly to antennas used with wireless communications devices.

BACKGROUND OF THE INVENTION

Radiotelephones generally refer to communications terminals which provide a wireless communications link to one or more other communications terminals. Radiotelephones may be used in a variety of different applications, including cellular telephone, land-mobile (e.g., police and fire departments), and satellite communications systems. Radiotelephones typically include an antenna for transmitting and/or receiving wireless communications signals. Historically, monopole and dipole antennas have been employed in various radiotelephone applications, due to their simplicity, wideband response, broad radiation pattern, and low cost.

However, radiotelephones and other wireless communications devices are undergoing miniaturization. Indeed, many contemporary radiotelephones are less than 11 centimeters in length. As a result, there is increasing interest in small antennas that can be utilized as internally-mounted antennas for radiotelephones.

In addition, it is becoming desirable for radiotelephones to be able to operate within multiple frequency bands in order to utilize more than one communications system. For example, GSM (Global System for Mobile) is a digital mobile telephone system that operates from 880 MHz to 960 MHz. DCS (Digital Communications System) is a digital mobile telephone system that operates from 1710 MHz to 1880 MHz. The frequency bands allocated for cellular AMPS (Advanced Mobile Phone Service) and D-AMPS (Digital Advanced Mobile Phone Service) in North America are 824–894 MHz and 1850–1990 MHz, respectively. Since there are two different frequency bands for these systems, radiotelephone service subscribers who travel over service areas employing different frequency bands may need two separate antennas unless a dual-frequency antenna is used.

In addition, radiotelephones may also incorporate Global Positioning System (GPS) technology and Bluetooth wireless technology. GPS is a constellation of spaced-apart satellites that orbit the Earth and make it possible for people with ground receivers to pinpoint their geographic location. Bluetooth technology provides a universal radio interface in the 2.45 GHz frequency band that enables portable electronic devices to connect and communicate wirelessly via short-range ad hoc networks. Accordingly, radiotelephones incorporating these technologies may require additional antennas tuned for the particular frequencies of GPS and Bluetooth.

Inverted-F antennas are designed to fit within the confines of radiotelephones, particularly radiotelephones undergoing miniaturization. As is well known to those having skill in the art, inverted-F antennas typically include a linear (i.e., straight) conductive element that is maintained in spaced apart relationship with a ground plane. Examples of inverted-F antennas are described in U.S. Pat. Nos. 5,684,492 and 5,434,579 which are incorporated herein by reference in their entirety.

Conventional inverted-F antennas, by design, resonate within a narrow frequency band, as compared with other types of antennas, such as helices, monopoles and dipoles. In addition, conventional inverted-F antennas are typically large. Lumped elements can be used to match a smaller non-resonant antenna to an RF circuit. Unfortunately, such an antenna may be narrow band and the lumped elements may introduce additional losses in the overall transmitted/received signal, may take up circuit board space, and may add to manufacturing costs.

Unfortunately, it may be unrealistic to incorporate multiple antennas within a radiotelephone for aesthetic reasons as well as for space-constraint reasons. In addition, some way of isolating multiple antennas operating simultaneously in close proximity within a radiotelephone may also be necessary. As such, a need exists for small, internal radiotelephone antennas that can operate within multiple frequency bands.

SUMMARY OF THE INVENTION

In view of the above discussion, the present invention can provide compact antennas that can radiate within multiple frequency bands for use within wireless communications devices, such as radiotelephones. An antenna according to an embodiment of the present invention includes first and second conductive branches. A first conductive branch has opposite ends, and first and second feeds extending therefrom adjacent one of the ends. The first and second feeds terminate at respective first and second microelectromechanical systems (MEMS) switches. The first MEMS switch is configured to selectively connect the first feed to either ground or to a receiver and/or a transmitter that receives and/or transmits wireless communications signals. The second MEMS switch is configured to selectively connect the second feed to either the same receiver/transmitter (or a different receiver/transmitter) or to maintain the second feed in an open circuit (i.e., electrically isolating the second feed).

A second conductive branch is in adjacent, spaced-apart relationship with the first conductive branch and has opposite ends. One end of the second conductive branch terminates at a third MEMS switch configured to selectively connect the second conductive branch to either a receiver/transmitter or to maintain the second conductive branch in an open circuit. The opposite end of the second conductive branch is connected to the first conductive branch via a fourth MEMS switch. The fourth MEMS switch is configured to be selectively closed to electrically connect the first and second conductive branches such that the antenna radiates as a loop antenna in a first frequency band. The fourth switch is also configured to open to electrically isolate the first and second conductive branches such that the antenna radiates as an inverted-F antenna in a second frequency band different from the first frequency band.

When the fourth MEMS switch is closed to electrically connect the first and second conductive branches, the first MEMS switch is connected to the receiver/transmitter, the second MEMS switch is open to isolate the second feed from the first conductive branch, and the third MEMS switch is connected to a receiver/transmitter. When the fourth MEMS switch is open to electrically isolate the first and second conductive branches, the first MEMS switch is connected to ground, the second MEMS switch is connected to the receiver/transmitter, and the third MEMS switch is open.

When the first and second conductive branches of an antenna according to the present invention are electrically connected such that the antenna radiates as a loop antenna in a first frequency band, the first MEMS switch may be connected to a first receiver that receives wireless communications signals in the first frequency band, such as a GPS receiver. When the first and second conductive branches are electrically isolated such that the antenna radiates as an inverted-F antenna in a second frequency band, the second switch may be connected to a second, different receiver that receives wireless communications signals in the second frequency band, such as a Bluetooth receiver.

According to additional embodiments of the present invention, portions (or all) of the first and second conductive branches may be disposed on or within one or more dielectric substrates. In addition, antennas according to the present invention may include second conductive branches with meandering configurations.

Antennas according to the present invention may be particularly well suited for use within a variety of communications systems utilizing different frequency bands. Furthermore, because of their compact size, antennas according to the present invention may be easily incorporated within small communications devices. Furthermore, antennas according to the present invention are ideal for use with receive-only applications such as GPS.

DETAILED DESCRIPTION OF THE INVENTION

Figure 1:
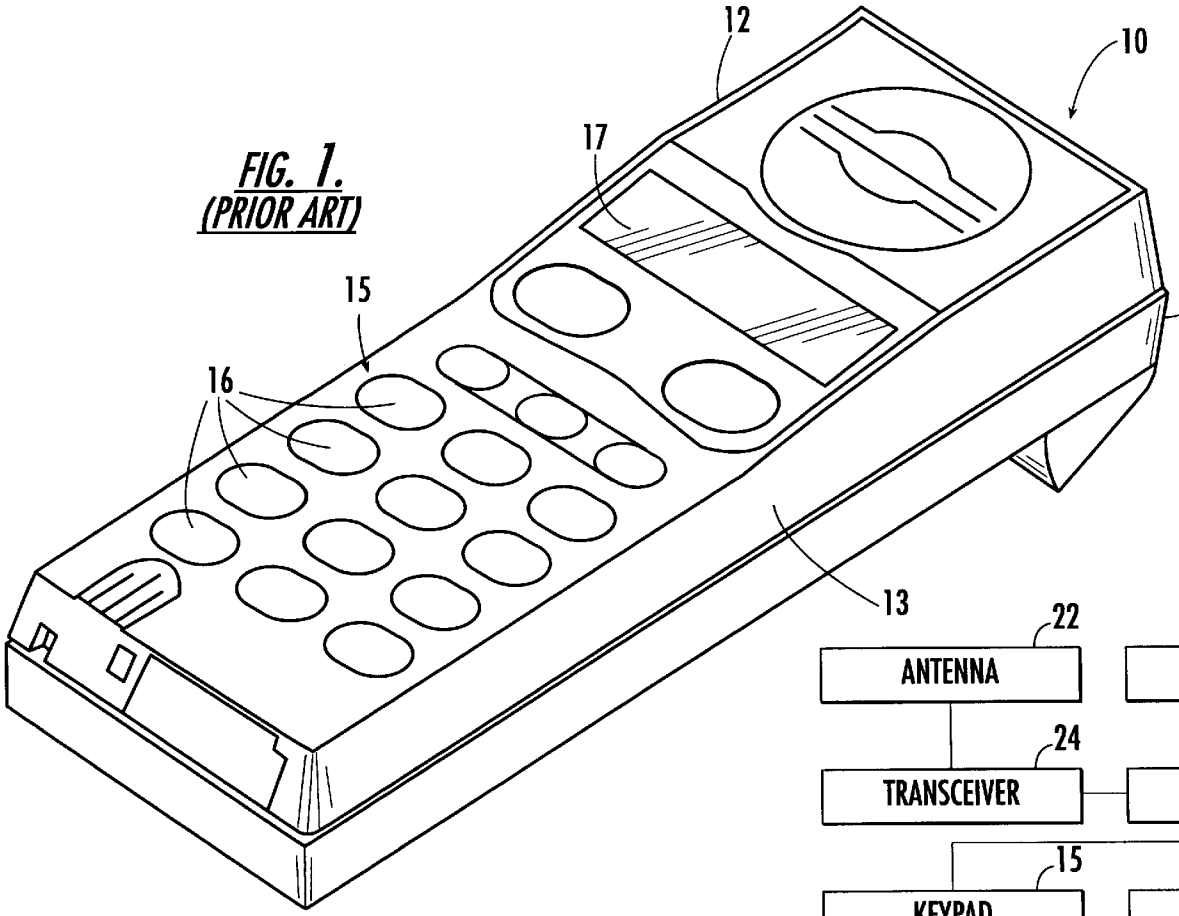
FIG. 1. (PRIOR ART)
FIG. 1 is a perspective view of an exemplary radiotelephone within which an antenna according to the present invention may be incorporated.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout the description of the drawings. It will be understood that when an element such as a layer, region or substrate is referred to as being "on" another element, it can be directly on the other element or intervening elements may also be present. In contrast, when an element is referred to as being "directly on" another element, there are no intervening elements present.

Referring now to FIG. 1, a radiotelephone 10, within which antennas according to various embodiments of the present invention may be incorporated, is illustrated. The housing 12 of the illustrated radiotelephone 10 includes a top portion 13 and a bottom portion 14 connected thereto to form a cavity therein. Top and bottom housing portions 13, 14 house a keypad 15 including a plurality of keys 16, a display 17, and electronic components (not shown) that enable the radiotelephone 10 to transmit and receive radiotelephone communications signals.

Figure 2:
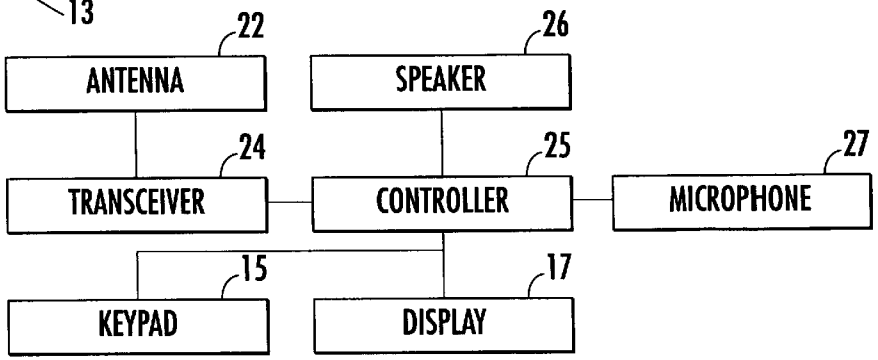
FIG. 2. (PRIOR ART)
FIG. 2 is a schematic illustration of a conventional arrangement of electronic components for enabling a radiotelephone to transmit and receive telecommunications signals.

A conventional arrangement of electronic components that enable a radiotelephone to transmit and receive radiotelephone communication signals is shown schematically in FIG. 2, and is understood by those skilled in the art of radiotelephone communications. An antenna 22 for receiving and transmitting radiotelephone communication signals is electrically connected to a radio-frequency transceiver 24 that is further electrically connected to a controller 25, such as a microprocessor. The controller 25 is electrically connected to a speaker 26 that transmits a remote signal from the controller 25 to a user of a radiotelephone. The controller 25 is also electrically connected to a microphone 27 that receives a voice signal from a user and transmits the voice signal through the controller 25 and transceiver 24 to a remote device. The controller 25 is electrically connected to a keypad 15 and display 17 that facilitate radiotelephone operation.

As is known to those skilled in the art of communications devices, an antenna is a device for transmitting and/or receiving electrical signals. A transmitting antenna typically includes a feed assembly that induces or illuminates an aperture or reflecting surface to radiate an electromagnetic field. A receiving antenna typically includes an aperture or surface focusing an incident radiation field to a collecting feed, producing an electronic signal proportional to the incident radiation. The amount of power radiated from or received by an antenna depends on its aperture area and is described in terms of gain.

Radiation patterns for antennas are often plotted using polar coordinates. Voltage Standing Wave Ratio (VSWR) relates to the impedance match of an antenna feed point with a feed line or transmission line of a communications device, such as a radiotelephone. To radiate radio frequency (RF) energy with minimum loss, or to pass along received RF energy to a radiotelephone receiver with minimum loss, the impedance of a radiotelephone antenna is conventionally matched to the impedance of a transmission line or feed point.

Conventional radiotelephones typically employ an antenna which is electrically connected to a transceiver operably associated with a signal processing circuit positioned on an internally disposed printed circuit board. In order to maximize power transfer between an antenna and a transceiver, the transceiver and the antenna are preferably interconnected such that their respective impedances are substantially "matched," i.e., electrically tuned to filter out or compensate for undesired antenna impedance components to provide a 50 Ohm (Ω) (or desired) impedance value at the feed point.

Figure 3:
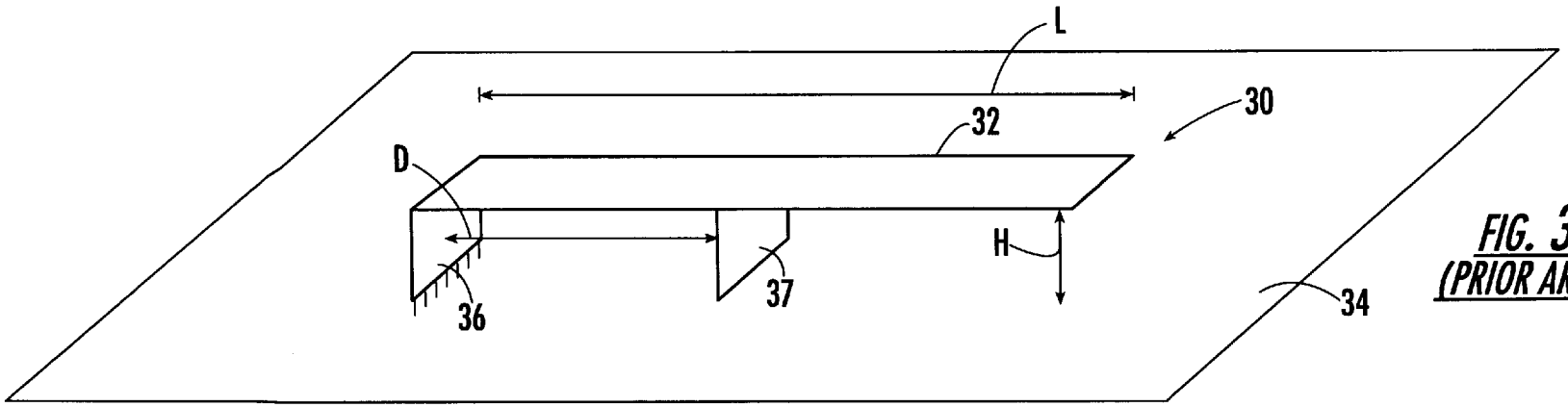
FIG. 3. (PRIOR ART)
FIG. 3 is a perspective view of a conventional planar inverted-F antenna.

Referring now to FIG. 3, a conventional planar inverted-F antenna is illustrated. The illustrated antenna 30 includes a linear conductive element 32 maintained in spaced apart relationship with a ground plane 34. Conventional inverted-F antennas, such as that illustrated in FIG. 3, derive their name from a resemblance to the letter "F." The illustrated conductive element 32 is grounded to the ground plane 34 as indicated by 36. A hot RF connection 37 extends from underlying RF circuitry through the ground plane 34 to the conductive element 32.

Figure 4A:
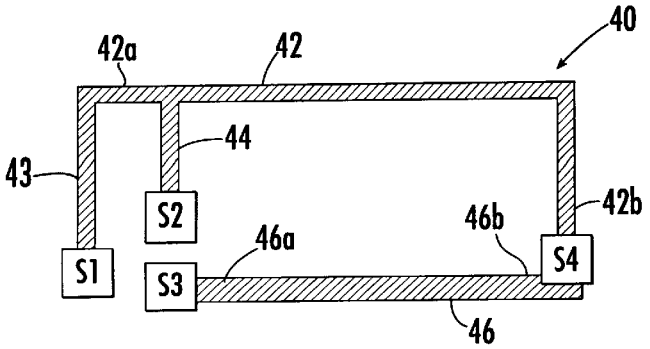
FIG. 4A schematically illustrates an antenna having first and second conductive branches that can be electrically connected and electrically isolated according to an embodiment of the present invention.

Referring now to FIG. 4A, a multiple frequency band antenna 40 according to an embodiment of the present invention that is convertible between a loop structure and an inverted-F structure is illustrated. The illustrated antenna 40 includes a first conductive branch 42 having opposite first and second ends 42*a*, 42*b*. First and second feeds 43, 44 extend from the first conductive branch 42 adjacent the first end 42*a*, as illustrated. The first and second feeds 43, 44 terminate at respective first and second switches S1, S2.

Preferably, the first and second switches are microelectromechanical systems (MEMS) switches. A MEMS switch is an integrated micro device that combines electrical and mechanical components fabricated using integrated circuit (IC) compatible batch-processing techniques and can range in size from micrometers to millimeters. MEMS devices in general, and MEMS switches in particular, are understood by those of skill in the art and need not be described further herein. Exemplary MEMS switches are described in U.S. Pat. No. 5,909,078. It also will be understood that conventional switches including relays and actuators may be used with antennas according to embodiments of the present invention.

The first switch S1 is configured to selectively connect the first feed 43 to either ground or a receiver that receives wireless communications signals. The second switch S2 is configured to selectively connect the second feed 44 to either a receiver or to maintain the second feed 44 in an open circuit (i.e., the second switch S2 can be open to electrically isolate the second feed 44).

Although described herein with respect to receivers that receive wireless communications signals, it is understood that antennas according to the present invention may be utilized with transmitters that transmit wireless communications signals. Furthermore, antennas according to the present invention may be utilized with transceivers that transmit and receive wireless communications signals.

Figure 4B:
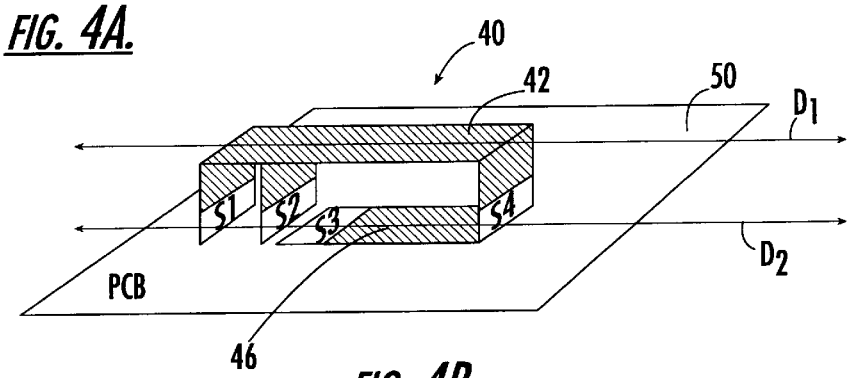
FIG. 4B is a perspective view of the antenna of FIG. 4A in an installed position within a wireless communications device, and wherein the second conductive branch extends along (and is electrically isolated from) a ground plane, and the first conductive branch is in overlying, spaced-apart relationship therewith.

Still referring to FIG. 4A, the illustrated antenna 40 also includes a second conductive branch 46 in adjacent, spaced-apart relationship with the first conductive branch 42. The first and second branches 42, 46 extend along generally parallel directions $D_1$, $D_2$, as illustrated in FIG. 4B. The second conductive branch 46 has opposite third and fourth ends 46*a*, 46*b*, as illustrated. The third end 46*a* terminates at a third switch S3 that is configured to selectively connect the second conductive branch 46 to either a receiver/transmitter or to an open circuit (i.e., the third switch S3 can be open). The fourth end 46*b* is electrically connected to the first conductive branch 42 via a fourth switch S4.

The fourth switch S4 is configured to be selectively closed to electrically connect the first and second conductive branches 42, 46 such that the antenna 40 radiates as a loop antenna in a first frequency band. The fourth switch S4 is also configured to be selectively open to electrically isolate the first and second conductive branches 42, 46 such that the antenna 40 radiates as an inverted-F antenna in a second frequency band different from the first frequency band. For example, the first frequency band may be between about 900 MHz and 960 MHz and the second frequency band may be between about 1200 MHz and 1400 MHz. However, it is understood that antennas according to the present invention may radiate in various frequency bands.

Referring to FIG. 4B, the antenna 40 of FIG. 4A is illustrated in an installed position within a wireless communications device, such as a radiotelephone (FIG. 1). The first conductive branch 42 is maintained in adjacent, spaced-apart relationship with the second conductive branch 46, as illustrated. The second conductive branch 46 is disposed on a ground plane 50, such as a printed circuit board (PCB) within a radiotelephone (or other wireless communications device) and is electrically isolated from the ground plane 50. As would be understood by those of skill in the art, the first, second, third, and fourth switches S1, S2, S3, S4 are electrically connected to circuitry that allows each to be selectively connected to ground, to a receiver/transmitter, or to an open circuit, as described above. It is noted that the fourth switch S4 is not normally connected to ground, however.

Figure 5A:
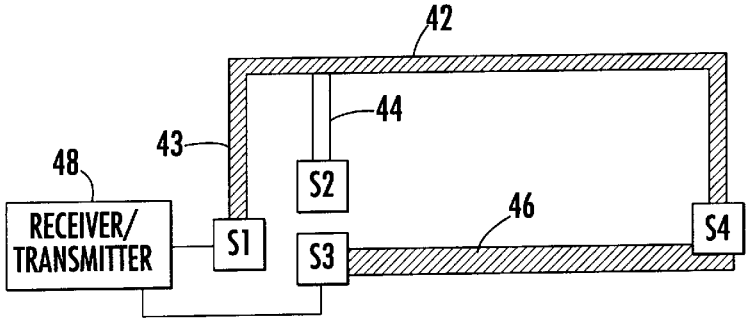
FIG. 5A schematically illustrates the antenna of FIG. 4A wherein the first and second conductive branches are electrically connected such that the antenna radiates as a loop antenna within a first frequency band.

Referring now to FIG. 5A, when the fourth switch S4 is closed to electrically connect the first and second conductive branches 42, 46, the first switch S1 is connected to a receiver/transmitter 48, the second switch S2 is open to isolate the second feed 44, and the third switch S3 is connected to the receiver/transmitter 48. The isolated second feed 44 is indicated by absence of shading.

Figure 5B:
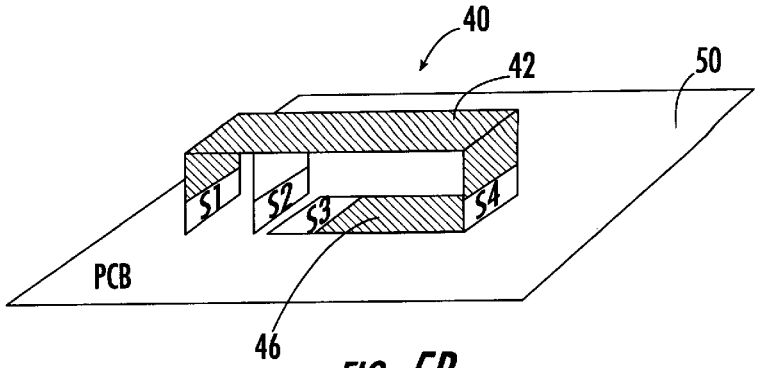
FIG. 5B is a perspective view of the antenna of FIG. 5A in an installed position within a wireless communications device.

Referring to FIG. 5B, the antenna 40 of FIG. 5A is illustrated in an installed position within a wireless communications device, such as a radiotelephone (FIG. 1) and wherein the first and second conductive branches 42, 46 are electrically connected such that the antenna 40 radiates as a loop antenna within a first frequency band. As illustrated, the second conductive branch 46 is disposed on a ground plane 50, such as a PCB within a radiotelephone (or other wireless communications device) and is electrically isolated from the ground plane 50. The first conductive branch 42 is maintained in adjacent, spaced-apart relationship with the second conductive branch 46, as illustrated.

Figure 6A:
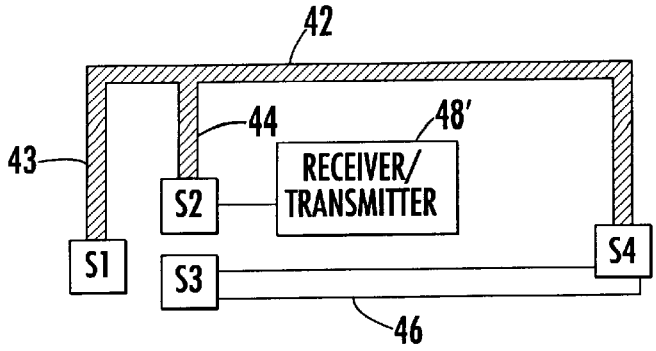
FIG. 6A schematically illustrates the antenna of FIG. 4A wherein the first and second conductive branches are electrically isolated such that the antenna radiates as an inverted-F antenna within a second frequency band different from the first frequency band.
Figure 6B:
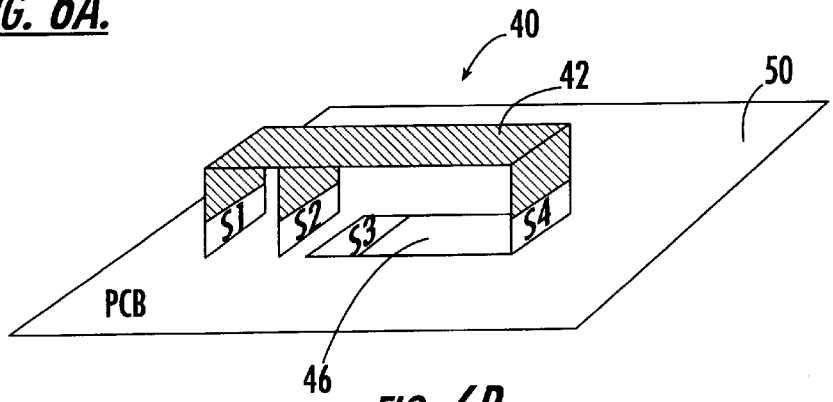
FIG. 6B is a perspective view of the antenna of FIG. 6A in an installed position within a wireless communications device.

Referring now to FIGS. 6A–6B, when the fourth switch S4 is open to electrically isolate the first and second conductive branches 42, 46, the first switch S1 is connected to ground and the second switch S2 is connected to a receiver/transmitter 48'. The isolated second conductive branch 46 is indicated by absence of shading.

In FIG. 6B, the antenna 40 of FIG. 6A is illustrated in an installed position within a wireless communications device, such as a radiotelephone (FIG. 1) and wherein the first and second conductive branches 42, 46 are electrically isolated such that the antenna 40 radiates as an inverted-F antenna within a second frequency band, different from the first frequency band of the loop antenna of FIGS. 5A–5B. The isolated second conductive branch 46 is indicated by absence of shading.

As illustrated, the second conductive branch 46 is disposed on a ground plane 50, such as a PCB within a radiotelephone (or other wireless communications device) and is electrically isolated from the ground plane 50. The first conductive branch 42 is maintained in adjacent, spaced-apart relationship with the second conductive branch 46, as illustrated.

It is understood that the antenna 40 of FIGS. 5A–5B and 6A–6B can be electrically connected to more than one receiver/transmitter. For example, when the first and second conductive branches 42, 46 are electrically connected such that the antenna 40 radiates as a loop antenna, the first switch S1 may be connected to a first receiver/transmitter 48 that receives/transmits wireless communications signals in a first frequency band. When the first and second conductive branches 42, 46 are electrically isolated such that the antenna 40 radiates as an inverted-F antenna, the second switch may be connected to a different receiver/transmitter 48' that receives/transmits wireless communications signals in a second, different frequency band.

For example, when the first and second conductive branches 42, 46 are electrically connected such that the antenna 40 radiates as a loop antenna, the first switch S1 may be connected to a GPS receiver that receives wireless communications signals in a first frequency band. When the first and second conductive branches 42, 46 are electrically isolated such that the antenna 40 radiates as an inverted-F antenna, the second switch may be connected to a Bluetooth receiver that receives wireless communications signals in a different frequency band.

Figure 7A:
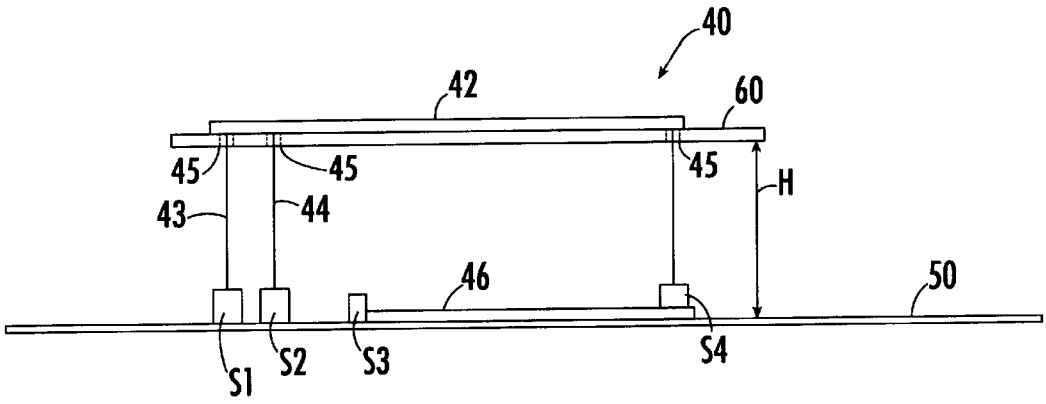
FIG. 7A is a side elevation view of a dielectric substrate having a first conductive branch disposed thereon, according to another embodiment of the present invention, and wherein the dielectric substrate is in adjacent, overlying relationship with a second conductive branch disposed on (and is electrically isolated from) a ground plane.

According to another embodiment, illustrated in FIG. 7A, all or portions of the first conductive branch 42 may be formed on a dielectric substrate 60, for example by etching a metal layer formed on the dielectric substrate. An exemplary material for use as a dielectric substrate 60 is FR4 or polyimide, which is well known to those having skill in the art of communications devices. However, various other dielectric materials also may be utilized. Preferably, the dielectric substrate 60 has a dielectric constant between about 2 and about 4. However, it is to be understood that dielectric substrates having different dielectric constants may be utilized without departing from the spirit and intent of the present invention.

The antenna 40 of FIG. 7A is illustrated in an installed position within a wireless communications device, such as a radiotelephone. The dielectric substrate 60 having the first conductive branch 42 disposed thereon is maintained in adjacent, spaced-apart relationship with a ground plane (PCB) 50. The first and second feeds 43, 44 extend through respective apertures 45 in the dielectric substrate 60. The distance H between the dielectric substrate 60 and the ground plane 50 is preferably maintained at between about 2 mm and about 10 mm. However, the distance H may be greater than 10 mm and less than 2 mm.

Figure 7B:
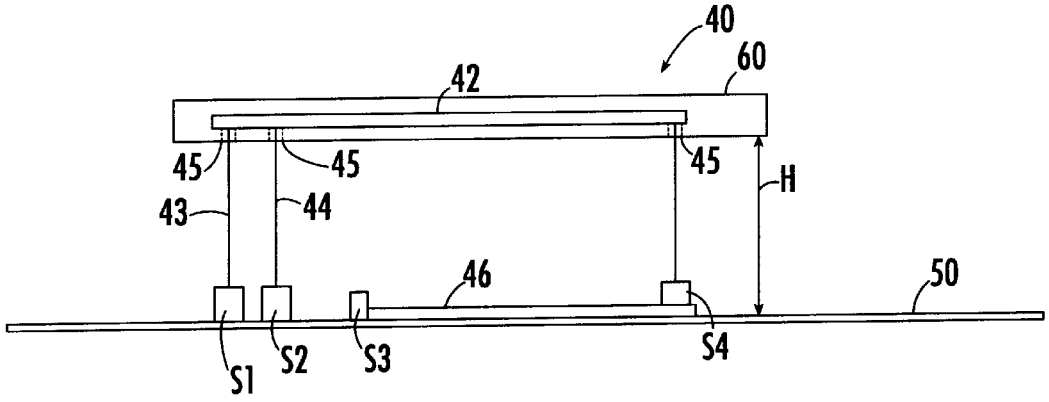
FIG. 7B is a side elevation view of a dielectric substrate having a first conductive branch disposed therein, according to another embodiment of the present invention, and wherein the dielectric substrate is in adjacent, overlying relationship with a second conductive branch disposed on (and is electrically isolated from) a ground plane.

According to another embodiment of the present invention illustrated in FIG. 7B, all or portions of the first conductive branch 42 may be disposed within a dielectric substrate 60.

A preferred conductive material out of which the first and second conductive branches 42, 46 of the antenna 40 may be formed is copper, typically 0.5 ounce (14 grams) copper. For example, the first and second conductive branches 42, 46 may be formed from copper foil. However, the first and second conductive branches 42, 46 according to the present invention may be formed from various conductive materials and are not limited to copper.

Figure 8A:
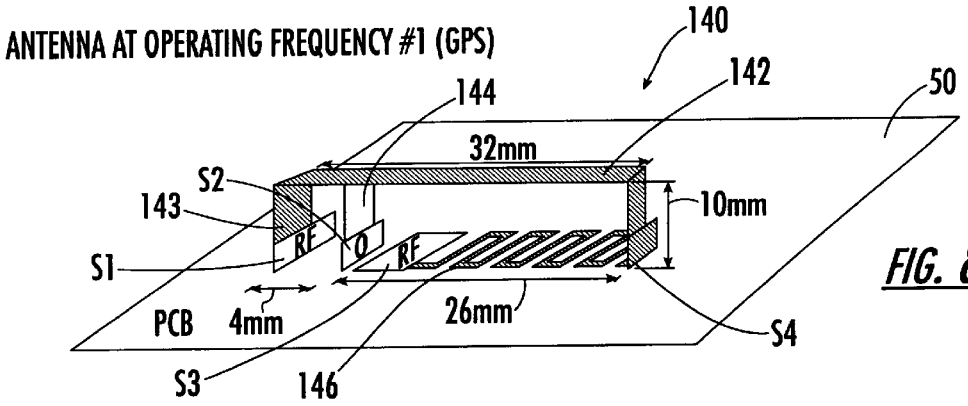
FIG. 8A is a perspective view of an antenna according to another embodiment of the present invention in an installed position within a wireless communications device, wherein the second conductive branch has a meandering configuration, and wherein the first and second conductive branches are electrically connected.
Figure 8B:
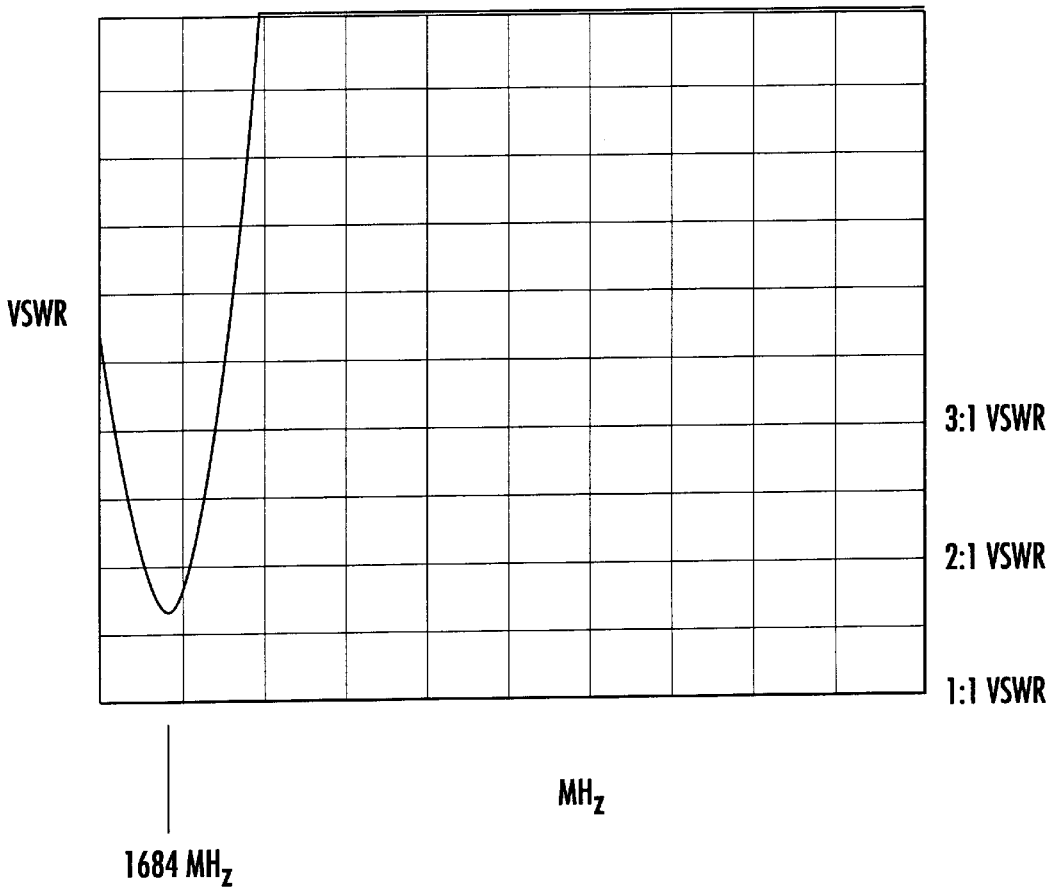
FIG. 8B is a graph of the VSWR performance of the antenna of FIG. 8A.

Referring now to FIGS. 8A–8B, an antenna 140 according to another embodiment of the present invention is illustrated. The antenna 140 includes first and second conductive branches 142, 146 electrically connected together so as to radiate as a loop antenna in a first frequency band centered around 1684 MHz, as illustrated in FIG. 8B. The second conductive branch 146 has a meandering configuration and is disposed on a ground plane (PCB) 50. It is understood that the second conductive branch 146 is electrically isolated from the ground plane 50. The first conductive branch 142 is maintained in overlying, spaced-apart relationship with the second conductive branch 146. The first conductive branch 142 also may have a meandering configuration.

First and second feeds 143, 144 extend from the first conductive branch 142 and terminate in first and second switches, such as MEMS switches S1, S2, as illustrated. The second conductive branch 146 terminates at a third switch, such as a MEMS switch S3. The first and second conductive branches 142, 146 are electrically connected via a fourth MEMS switch S4. The fourth switch S4 is closed to electrically connect the first and second conductive branches 142, 146. The first switch S1 is connected to a receiver/transmitter (indicated by RF), the second switch S2 is open (indicated by O) to isolate the second feed 144 from the first conductive branch 142, and the third switch S3 is connected to the receiver/transmitter (indicated by RF).

Figure 9A:
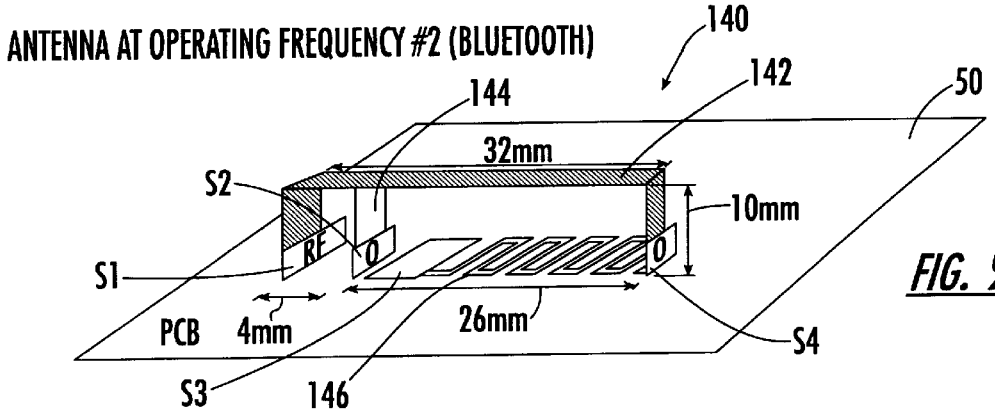
FIG. 9A is a perspective view of an antenna according to another embodiment of the present invention in an installed position within a wireless communications device, wherein the second conductive branch has a meandering configuration, and wherein the first and second conductive branches are electrically isolated.
Figure 9B:
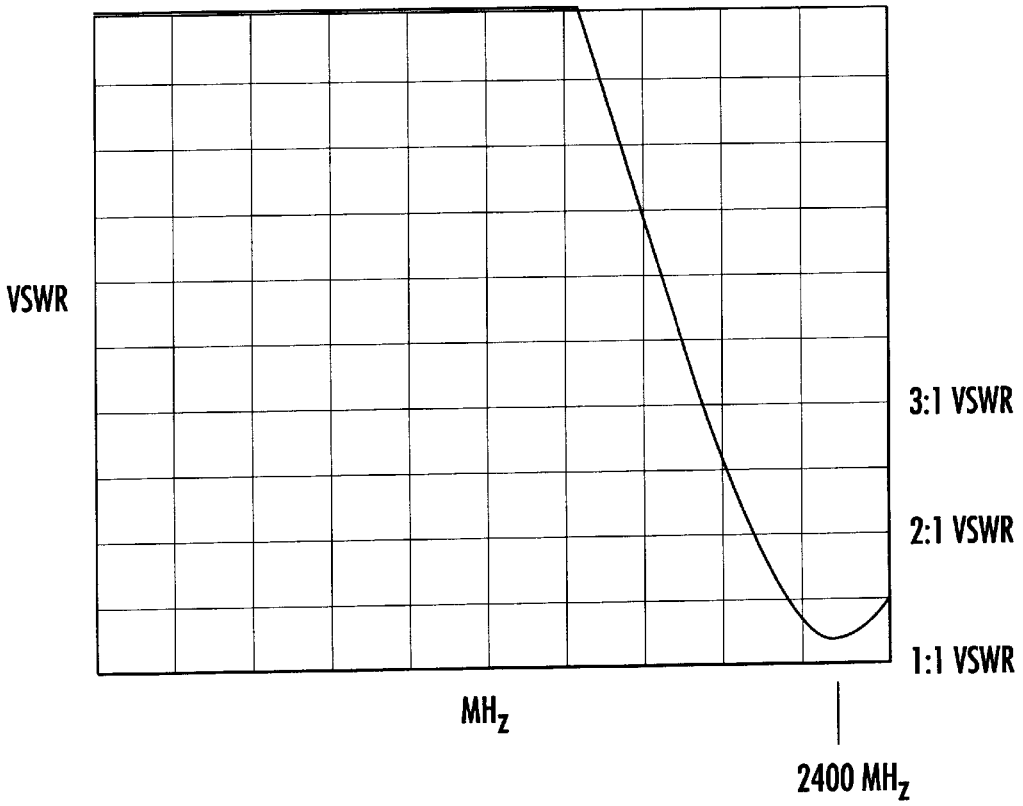
FIG. 9B is a graph of the VSWR performance of the antenna of FIG. 9A.

Referring now to FIGS. 9A–9B, the antenna 140 of FIGS. 8A–8B is illustrated with the first and second conductive branches 142, 146 electrically isolated so that the antenna 140 radiates as an inverted-F antenna in a second frequency band centered around 2400 MHz (FIG. 8B).

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or a receiver that receives wireless communications signals or a transmitter that transmits wireless communications signals, and wherein the second switch is configured to selectively connect the second feed to the receiver or to the transmitter or to maintain the second feed in an open circuit; and a second conductive branch in adjacent, spaced-apart relationship with the first conductive branch and having opposite third and fourth ends, wherein the third end terminates at a third switch configured to selectively connect the second conductive branch to the receiver or to the transmitter or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band;

wherein when the fourth switch is closed to electrically connect the first and second conductive branches, the first switch is connected to the receiver or transmitter, the second switch is open to isolate the second feed from the first conductive branch, and the third switch is connected to the receiver or transmitter.

2. The antenna according to claim 1 wherein when the fourth switch is open to electrically isolate the first and second conductive branches, the first switch is connected to ground and the second switch is connected to the receiver or transmitter.

3. The antenna according to claim 1 wherein the first and second branches extend along generally parallel directions.

4. The antenna according to claim 1 wherein the first and second switches comprise micro-electromechanical systems (MEMS) switches.

5. The antenna according to claim 1 wherein the second conductive branch comprises a meandering configuration.

6. The antenna according to claim 1 wherein a portion of at least one of the first and second conductive branches is disposed on a respective surface of a dielectric substrate.

7. The antenna according to claim 1 wherein a portion of at least one of the first and second conductive branches is disposed within a dielectric substrate.

8. The antenna according to claim 1 wherein when the first and second conductive branches are electrically connected such that the antenna radiates as a loop antenna in a first frequency band, the first switch is connected to a first receiver that receives wireless communications signals in the first frequency band.

9. The antenna according to claim 8 wherein when the first and second conductive branches are electrically isolated such that the antenna radiates as an inverted-F antenna in a second frequency band, the second switch is connected to a second receiver that receives wireless communications signals in the second frequency band.

10. A wireless communicator, comprising:

a housing configured to enclose a receiver that receives wireless communications signals;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or to a receiver that receives wireless communications signals, and wherein the second switch is configured to selectively connect the second feed to a receiver or to maintain the second feed in an open circuit; and a second conductive branch in adjacent, spaced-apart relationship with the first conductive branch and having opposite third and fourth ends, wherein the third end terminates at a third switch configured to selectively connect the second conductive branch to a receiver or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band;

wherein when the fourth switch is closed to electrically connect the first and second conductive branches, the first switch is connected to a receiver, the second switch is open to isolate the second feed from the first conductive branch, and the third switch is connected to a receiver.

11. The wireless communicator according to claim 10 wherein when the fourth switch is open to electrically isolate the first and second conductive branches, the first switch is connected to ground and the second switch is connected to a receiver.

12. The wireless communicator according to claim 10 wherein the first and second branches extend along generally parallel directions.

13. The wireless communicator according to claim 10 wherein the first and second switches comprise micro-electromechanical systems (MEMS) switches.

14. The wireless communicator according to claim 10 wherein the second conductive branch comprises a meandering configuration.

15. The wireless communicator according to claim 10 wherein a portion of at least one of the first and second conductive branches is disposed on a respective surface of a dielectric substrate.

16. The wireless communicator according to claim 10 wherein a portion of at least one of the first and second conductive branches is disposed within a dielectric substrate.

17. The wireless communicator according to claim 10 wherein when the first and second conductive branches are electrically connected such that the antenna radiates as a loop antenna in a first frequency band, the first switch is connected to a first receiver that receives wireless communications signals in the first frequency band.

18. The wireless communicator according to claim 17 wherein when the first and second conductive branches are electrically isolated such that the antenna radiates as an inverted-F antenna in a second frequency band, the second switch is connected to a second receiver that receives wireless communications signals in the second frequency band.

19. The wireless communicator according to claim 10 wherein the wireless communicator comprises a radiotelephone.

20. A radiotelephone, comprising:

a housing configured to enclose first and second transceivers that transmit and receive wireless communications signals in respective different first and second frequency bands;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second micro-electromechanical systems (MEMS) switches, wherein the first MEMS switch is configured to selectively connect the first feed to ground or the first transceiver, and wherein the second MEMS switch is configured to selectively connect the second feed to the second transceiver or to maintain the second feed in an open circuit; and a second conductive branch in adjacent, spaced-apart relationship with the first conductive branch and having opposite third and fourth ends, wherein the third end terminates at a third MEMS switch configured to selectively connect the second conductive branch to the first transceiver or to maintain the second conductive branch in an open circuit, and wherein the fourth end is connected to the first conductive branch via a fourth MEMS switch, wherein the fourth MEMS switch is configured to be selectively closed to electrically connect the first and second conductive branches such that the antenna radiates as a loop antenna in the first frequency band, and wherein the fourth MEMS switch is configured to be selectively open to electrically isolate the first and second conductive branches such that the antenna radiates as an inverted-F antenna in the second frequency band;

wherein when the fourth MEMS switch is closed to electrically connect the first and second conductive branches, the first MEMS switch is connected to the first transceiver, the second MEMS switch is open to isolate the second feed from the first conductive branch, and the third MEMS switch is connected to the first transceiver.

21. The radiotelephone according to claim 20 wherein when the fourth MEMS switch is open to electrically isolate the first and second conductive branches, the first MEMS switch is connected to ground and the second MEMS switch is connected to the second transceiver.

22. The radiotelephone according to claim 20 wherein the first and second branches extend along generally parallel directions.

23. The radiotelephone according to claim 20 wherein the second conductive branch comprises a meandering configuration.

24. The radiotelephone according to claim 20 wherein a portion of at least one of the first and second conductive branches is disposed on a respective surface of a dielectric substrate.

25. The radiotelephone according to claim 20 wherein a portion of at least one of the first and second conductive branches is disposed within a dielectric substrate.

26. A multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or a receiver that receives wireless communications signals or a transmitter that transmits wireless communications signals, and wherein the second switch is configured to selectively connect the second feed to the receiver or to the transmitter or to maintain the second feed in an open circuit; and a second conductive branch in adjacent, spaced-apart relationship with the first conductive branch and having opposite third and fourth ends, wherein the first and second conductive branches extend along generally parallel directions, wherein the third end terminates at a third switch configured to selectively connect the second conductive branch to the receiver or to the transmitter or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band.

27. The antenna according to claim 26 wherein when the fourth switch is closed to electrically connect the first and second conductive branches, the first switch is connected to the receiver or transmitter, the second switch is open to isolate the second feed from the first conductive branch, and the third switch is connected to the receiver or transmitter.

28. The antenna according to claim 26 wherein when the fourth switch is open to electrically isolate the first and second conductive branches, the first switch is connected to ground and the second switch is connected to the receiver or transmitter.

29. The antenna according to claim 26 wherein the first and second switches comprise micro-electromechanical systems (MEMS) switches.

30. The antenna according to claim 26 wherein the second conductive branch comprises a meandering configuration.

31. The antenna according to claim 26 wherein a portion of at least one of the first and second conductive branches is disposed on a respective surface of a dielectric substrate.

32. The antenna according to claim 26 wherein a portion of at least one of the first and second conductive branches is disposed within a dielectric substrate.

33. The antenna according to claim 26 wherein when the first and second conductive branches are electrically connected such that the antenna radiates as a loop antenna in a first frequency band, the first switch is connected to a first receiver that receives wireless communications signals in the first frequency band.

34. The antenna according to claim 33 wherein when the first and second conductive branches are electrically isolated such that the antenna radiates as an inverted-F antenna in a second frequency band, the second switch is connected to a second receiver that receives wireless communications signals in the second frequency band.

35. A multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or a receiver that receives wireless communications signals or a transmitter that transmits wireless communications signals, and wherein the second switch is configured to selectively connect the second feed to the receiver or to the transmitter or to maintain the second feed in an open circuit; and a second conductive branch in adjacent, spaced-apart relationship with the first conductive branch and having a meandering configuration with opposite third and fourth ends, wherein the third end terminates at a third switch configured to selectively connect the second conductive branch to the receiver or to the transmitter or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band.

36. The antenna according to claim 35 wherein when the fourth switch is closed to electrically connect the first and second conductive branches, the first switch is connected to the receiver or transmitter, the second switch is open to isolate the second feed from the first conductive branch, and the third switch is connected to the receiver or transmitter.

37. The antenna according to claim 35 wherein when the fourth switch is open to electrically isolate the first and second conductive branches, the first switch is connected to ground and the second switch is connected to the receiver or transmitter.

38. The antenna according to claim 35 wherein the first and second branches extend along generally parallel directions.

39. The antenna according to claim 35 wherein the first and second switches comprise micro-electromechanical systems (MEMS) switches.

40. The antenna according to claim 35 wherein a portion of at least one of the first and second conductive branches is disposed on a respective surface of a dielectric substrate.

41. The antenna according to claim 35 wherein a portion of at least one of the first and second conductive branches is disposed within a dielectric substrate.

42. The antenna according to claim 35 wherein when the first and second conductive branches are electrically connected such that the antenna radiates as a loop antenna in a first frequency band, the first switch is connected to a first receiver that receives wireless communications signals in the first frequency band.

43. The antenna according to claim 42 wherein when the first and second conductive branches are electrically isolated such that the antenna radiates as an inverted-F antenna in a second frequency band, the second switch is connected to a second receiver that receives wireless communications signals in the second frequency band.

44. A wireless communicator, comprising:

a housing configured to enclose a receiver that receives wireless communications signals;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or to a receiver that receives wireless communications signals, and wherein the second switch is configured to selectively connect the second feed to a receiver or to maintain the second feed in an open circuit; and a second conductive branch in adjacent, spaced-apart relationship with the first conductive branch and having opposite third and fourth ends, wherein the first and second conductive branches extend along generally parallel directions, wherein the third end terminates at a third switch configured to selectively connect the second conductive branch to a receiver or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band.

45. The wireless communicator according to claim 44 wherein when the fourth switch is closed to electrically connect the first and second conductive branches, the first switch is connected to a receiver, the second switch is open to isolate the second feed from the first conductive branch, and the third switch is connected to a receiver.

46. The wireless communicator according to claim 44 wherein when the fourth switch is open to electrically isolate the first and second conductive branches, the first switch is connected to ground and the second switch is connected to a receiver.

47. The wireless communicator according to claim 44 wherein the first and second switches comprise micro-electromechanical systems (MEMS) switches.

48. The wireless communicator according to claim 44 wherein the second conductive branch comprises a meandering configuration.

49. The wireless communicator according to claim 44 wherein a portion of at least one of the first and second conductive branches is disposed on a respective surface of a dielectric substrate.

50. The wireless communicator according to claim 44 wherein a portion of at least one of the first and second conductive branches is disposed within a dielectric substrate.

51. The wireless communicator according to claim 44 wherein when the first and second conductive branches are electrically connected such that the antenna radiates as a loop antenna in a first frequency band, the first switch is connected to a first receiver that receives wireless communications signals in the first frequency band.

52. The wireless communicator according to claim 51 wherein when the first and second conductive branches are electrically isolated such that the antenna radiates as an inverted-F antenna in a second frequency band, the second switch is connected to a second receiver that receives wireless communications signals in the second frequency band.

53. The wireless communicator according to claim 44 wherein the wireless communicator comprises a radiotelephone.

54. A wireless communicator, comprising:

a housing configured to enclose a receiver that receives wireless communications signals;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second switches, wherein the first switch is configured to selectively connect the first feed to ground or to a receiver that receives wireless communications signals, and wherein the second switch is configured to selectively connect the second feed to a receiver or to maintain the second feed in an open circuit; and a second conductive branch in adjacent, spaced-apart relationship with the first conductive branch and having a meandering configuration with opposite third and fourth ends, wherein the third end terminates at a third switch configured to selectively connect the second conductive branch to a receiver or to maintain the second conductive branch in an open circuit, and wherein the fourth end is connected to the first conductive branch via a fourth switch, wherein the fourth switch is configured to be selectively closed to electrically connect the first and second conductive branches such that the antenna radiates as a loop antenna in a first frequency band, and wherein the fourth switch is configured to be selectively open to electrically isolate the first and second conductive branches such that the antenna radiates as an inverted-F antenna in a second frequency band different from the first frequency band.

55. The wireless communicator according to claim 54 wherein when the fourth switch is closed to electrically connect the first and second conductive branches, the first switch is connected to a receiver, the second switch is open to isolate the second feed from the first conductive branch, and the third switch is connected to a receiver.

56. The wireless communicator according to claim 54 wherein when the fourth switch is open to electrically isolate the first and second conductive branches, the first switch is connected to ground and the second switch is connected to a receiver.

57. The wireless communicator according to claim 54 wherein the first and second branches extend along generally parallel directions.

58. The wireless communicator according to claim 54 wherein the first and second switches comprise micro-electromechanical systems (MEMS) switches.

59. The wireless communicator according to claim 54 wherein a portion of at least one of the first and second conductive branches is disposed on a respective surface of a dielectric substrate.

60. The wireless communicator according to claim 54 wherein a portion of at least one of the first and second conductive branches is disposed within a dielectric substrate.

61. The wireless communicator according to claim 54 wherein when the first and second conductive branches are electrically connected such that the antenna radiates as a loop antenna in a first frequency band, the first switch is connected to a first receiver that receives wireless communications signals in the first frequency band.

62. The wireless communicator according to claim 61 wherein when the first and second conductive branches are electrically isolated such that the antenna radiates as an inverted-F antenna in a second frequency band, the second switch is connected to a second receiver that receives wireless communications signals in the second frequency band.

63. The wireless communicator according to claim 54 wherein the wireless communicator comprises a radiotelephone.

64. A radiotelephone, comprising:

a housing configured to enclose first and second transceivers that transmit and receive wireless communications signals in respective different first and second frequency bands;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second micro-electromechanical systems (MEMS) switches, wherein the first MEMS switch is configured to selectively connect the first feed to ground or the first transceiver, and wherein the second MEMS switch is configured to selectively connect the second feed to the second transceiver or to maintain the second feed in an open circuit; and a second conductive branch in adjacent, spaced-apart relationship with the first conductive branch and having opposite third and fourth ends, wherein the first and second conductive branches extend along generally parallel directions, wherein the third end terminates at a third MEMS switch configured to selectively connect the second conductive branch to the first transceiver or to maintain the second conductive branch in an open circuit, and wherein the fourth end is connected to the first conductive branch via a fourth MEMS switch, wherein the fourth MEMS switch is configured to be selectively closed to electrically connect the first and second conductive branches such that the antenna radiates as a loop antenna in the first frequency band, and wherein the fourth MEMS switch is configured to be selectively open to electrically isolate the first and second conductive branches such that the antenna radiates as an inverted-F antenna in the second frequency band.

65. The radiotelephone according to claim 64 wherein when the fourth MEMS switch is closed to electrically connect the first and second conductive branches, the first MEMS switch is connected to the first transceiver, the second MEMS switch is open to isolate the second feed from the first conductive branch, and the third MEMS switch is connected to the first transceiver.

66. The radiotelephone according to claim 64 wherein when the fourth MEMS switch is open to electrically isolate the first and second conductive branches, the first MEMS switch is connected to ground and the second MEMS switch is connected to the second transceiver.

67. The radiotelephone according to claim 64 wherein the first and second branches extend along generally parallel directions.

68. The radiotelephone according to claim 64 wherein the second conductive branch comprises a meandering configuration.

69. The radiotelephone according to claim 64 wherein a portion of at least one of the first and second conductive branches is disposed on a respective surface of a dielectric substrate.

70. The radiotelephone according to claim 64 wherein a portion of at least one of the first and second conductive branches is disposed within a dielectric substrate.

71. A radiotelephone, comprising:

a housing configured to enclose first and second transceivers that transmit and receive wireless communications signals in respective different first and second frequency bands;

a ground plane disposed within the housing; and a multiple frequency band antenna, comprising:

a first conductive branch having opposite first and second ends;

first and second feeds extending from the first conductive branch adjacent the first end, wherein the first and second feeds terminate at respective first and second micro-electromechanical systems (MEMS) switches, wherein the first MEMS switch is configured to selectively connect the first feed to ground or the first transceiver, and wherein the second MEMS switch is configured to selectively connect the second feed to the second transceiver or to maintain the second feed in an open circuit; and a second conductive branch in adjacent, spaced-apart relationship with the first conductive branch and having a meandering configuration with opposite third and fourth ends, wherein the third end terminates at a third MEMS switch configured to selectively connect the second conductive branch to the first transceiver or to maintain the second conductive branch in an open circuit, and wherein the fourth end is connected to the first conductive branch via a fourth MEMS switch, wherein the fourth MEMS switch is configured to be selectively closed to electrically connect the first and second conductive branches such that the antenna radiates as a loop antenna in the first frequency band, and wherein the fourth MEMS switch is configured to be selectively open to electrically isolate the first and second conductive branches such that the antenna radiates as an inverted-F antenna in the second frequency band.

72. The radiotelephone according to claim 71 wherein when the fourth MEMS switch is closed to electrically connect the first and second conductive branches, the first MEMS switch is connected to the first transceiver, the second MEMS switch is open to isolate the second feed from the first conductive branch, and the third MEMS switch is connected to the first transceiver.

73. The radiotelephone according to claim 71 wherein when the fourth MEMS switch is open to electrically isolate the first and second conductive branches, the first MEMS switch is connected to ground and the second MEMS switch is connected to the second transceiver.

74. The radiotelephone according to claim 71 wherein the first and second branches extend along generally parallel directions.

75. The radiotelephone according to claim 71 wherein the second conductive branch comprises a meandering configuration.

76. The radiotelephone according to claim 71 wherein a portion of at least one of the first and second conductive branches is disposed on a respective surface of a dielectric substrate.

77. The radiotelephone according to claim 71 wherein a portion of at least one of the first and second conductive branches is disposed within a dielectric substrate.

* * * * *